US008440927B2

(12) United States Patent
Lin et al.

(10) Patent No.: US 8,440,927 B2
(45) Date of Patent: May 14, 2013

(54) ENHANCED RETURNING ELASTICITY MICRO SWITCH

(75) Inventors: Ching-Hsin Lin, New Taipei (TW); King-Long Lee, New Taipei (TW)

(73) Assignee: Zippy Technology Corp., New Taipei (TW)

( * ) Notice: Subject to any disclaimer, the term of this patent is extended or adjusted under 35 U.S.C. 154(b) by 232 days.

(21) Appl. No.: 13/016,668

(22) Filed: Jan. 28, 2011

(65) Prior Publication Data

US 2012/0193196 A1 Aug. 2, 2012

(51) Int. Cl.
*H01H 5/14* (2006.01)

(52) U.S. Cl.
USPC ..... 200/408

(58) Field of Classification Search ..... 200/405, 200/407–409, 440, 442, 449, 450, 451, 453, 200/459–461, 520
See application file for complete search history.

(56) References Cited

U.S. PATENT DOCUMENTS

| | | | | |
|---|---|---|---|---|
| 4,254,313 | A * | 3/1981 | Baader | 200/452 |
| 5,111,010 | A * | 5/1992 | Kokubu et al. | 200/461 |
| 5,459,295 | A * | 10/1995 | Ohta et al. | 200/461 |
| 6,713,702 | B1 * | 3/2004 | Lee | 200/520 |
| 7,081,593 | B2 * | 7/2006 | Hopkins | 200/402 |
| 7,205,496 | B2 * | 4/2007 | Schober et al. | 200/329 |
| 7,232,971 | B2 * | 6/2007 | Chen | 200/460 |
| 7,371,983 | B1 * | 5/2008 | Lin et al. | 200/237 |

FOREIGN PATENT DOCUMENTS

| | | |
|---|---|---|
| TW | 289485 | 10/1996 |
| TW | 507921 | 10/2002 |
| TW | M350087 | 2/2009 |

* cited by examiner

*Primary Examiner* — Edwin A. Leon
(74) *Attorney, Agent, or Firm* — Muncy, Geissler, Olds & Lowe, PLLC

(57) ABSTRACT

An enhanced returning elasticity micro switch includes a base and a cap mounted thereon to form a housing compartment therebetween. The base is run through by a first pin and a second pin. The first pin has an anchor portion in the housing compartment to couple with a conductive member. The conductive member has a lower contact portion and swings when being pressed. The second pin has a first contact in the housing compartment. The first contact has an inclined surface connected to the lower contact portion during swing of the conductive member. The inclined surface is located at an elevation tapered towards the anchor portion. Hence the contact area between the conductive member and second pin increases, and adhesion force between the conductive member and second pin during power transmission decreases. Returning elasticity of the conductive member increases, and resistance against depression of the conductive member decreases.

6 Claims, 5 Drawing Sheets

ENHANCED RETURNING ELASTICITY MICRO SWITCH

FIELD OF THE INVENTION

The present invention relates to an enhanced returning elasticity micro switch and particularly to a micro switch having enhanced returning elasticity upon being depressed.

BACKGROUND OF THE INVENTION

Advance of technology has made all kinds of electronic devices (such as mouse) smaller. Electronic elements required by those electronic devices also have to be miniaturized. In the electronic devices, switch is the commonly used electronic element to transmit signals.

References for micro switch are seen in numerous prior arts, such as R.O.C. patent Nos. M350087, 507921 and 289485. R.O.C. patent No. M350087 discloses a micro switch including a housing, a common terminal, a normally-closed terminal, a normally-open terminal, a movable contact plate, a tension spring, a pushbutton and a pressing plate. The pressing plate has a dovetail portion to increase the force receiving area of the housing from the pressing plate to avoid the housing from being pierced through. In addition, the tension spring improves control of received force of the movable contact plate to obtain uniform and agile action force, thereby to further enhance performance and reliability of the movable contact plate.

R.O.C. patent No. 507921 also discloses a micro switch including an upper body and a lower body coupled together, a conduction contact and a fixed contact surface on the top of the lower body, an action member with a fixed end anchored on the fixed contact surface and a movable end fastened to a contact element. When a press element is pressed, the bottom thereof is to push the action member. The movable end of the action member is moved accordingly to allow the contact element to contact with the conduction contact to achieve switch function.

R.O.C. patent No. 289485 discloses a micro switch with a detent rib that has a cap with two protrusive rectangular ribs on the surface to control depression movement of the switch to improve durability.

While all the aforesaid prior arts have varying objectives and functions, they have a common feature. Referring to FIG. 1, a micro switch is provided and similar to the micro switches disclosed in the aforesaid prior arts. The micro switch includes a base 30 which has a common terminal 31, a normally-closed terminal 32 and a normally-open terminal 33. The common terminal 31 is coupled with a conductive reed 34. The conductive reed 34 and the normally-open terminal 33 have respectively a first contact portion 341 and a second contact portion 331 corresponding to each other. The conductive reed 34 contacts the normally-closed terminal 32 in normal conditions. When being depressed, the first contact portion 341 presses the second contact portion 331 of the normally-open terminal 33 to form electrical connection between the common terminal 31 and normally-open terminal 33 to output a command or a signal However, when the conductive reed 34 is pressed, the first contact portion 341 thereof is not moved downwards to contact the second contact portion 331 of the normally-open terminal 33. In fact, the conductive reed 34 has one end connected with the common terminal to function as a fixed end and generates deformation to swing downwards. The second contact portion 331 of the normally-open terminal 33 is formed in a horizontal structure. After the first contact portion 341 swings downwards to generate angle alterations, the first contact portion 341 and the second contact portion 331 are merely connected at a contact point to transmit electric power between the common terminal 31 and normally-open terminal 33. Such operation generates following problems:

1. The area of power transmission is too small, thus results in higher temperature on the contact point between the first contact portion 341 and second contact portion 331.
2. The first contact portion 341 and the second contact portion 331 have greater attraction between them and generate an adhesive phenomenon, thus results in inadequate returning elasticity of the conductive reed 34.
3. To increase the returning elasticity, the elevation of the second contact portion 331 must be higher, thus the distance between the normally-closed terminal 32 and normally-open terminal 33 is shortened. This causes decrease of withstand voltage.
4. The distance that the conductive reed 34 swings downward is relatively short, and the conductive reed 34 also is braced by an edge of the second contact portion 331, hence pressing resistance increases.

SUMMARY OF THE INVENTION

The primary object of the present invention is to solve the aforesaid disadvantages to increase the contact area and enhance returning elasticity of the reed.

To achieve the foregoing object, the invention provides an enhanced returning elasticity micro switch that includes a base, and a first pin and a second pin running through the base. The base has a cap mounted thereon to form a housing compartment between them. The cap has a press element movable up and down. The first pin has an anchor portion in the housing compartment to couple with a conductive member depressed by the press element. The conductive member has a lower contact portion and swings during up and down movement of the press element. The second pin has a first contact located in the housing compartment. The first contact has an inclined surface connected to the lower contact portion during swing of the conductive member. The inclined surface is formed at an elevation tapered towards the anchor portion of the first pin. Moreover, in embodiments of the invention, the contact surface and inclined surface may be plane surfaces or cambered surfaces contacted with each other. The conductive member is a conductive reed and contains an elastic element braced by the anchor portion. The elastic element braces the contact surface escaped away from the inclined surface in normal conditions.

By means of the structure set forth above, the contact area between the conductive member and the second pin increases, the adhesion force between the conductive member and second pin during power transmission can be reduced, and the returning elasticity of the conductive member is enhanced. The resistance against downward depression of the conductive member also is smaller. Hence operation of the micro switch is smoother.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
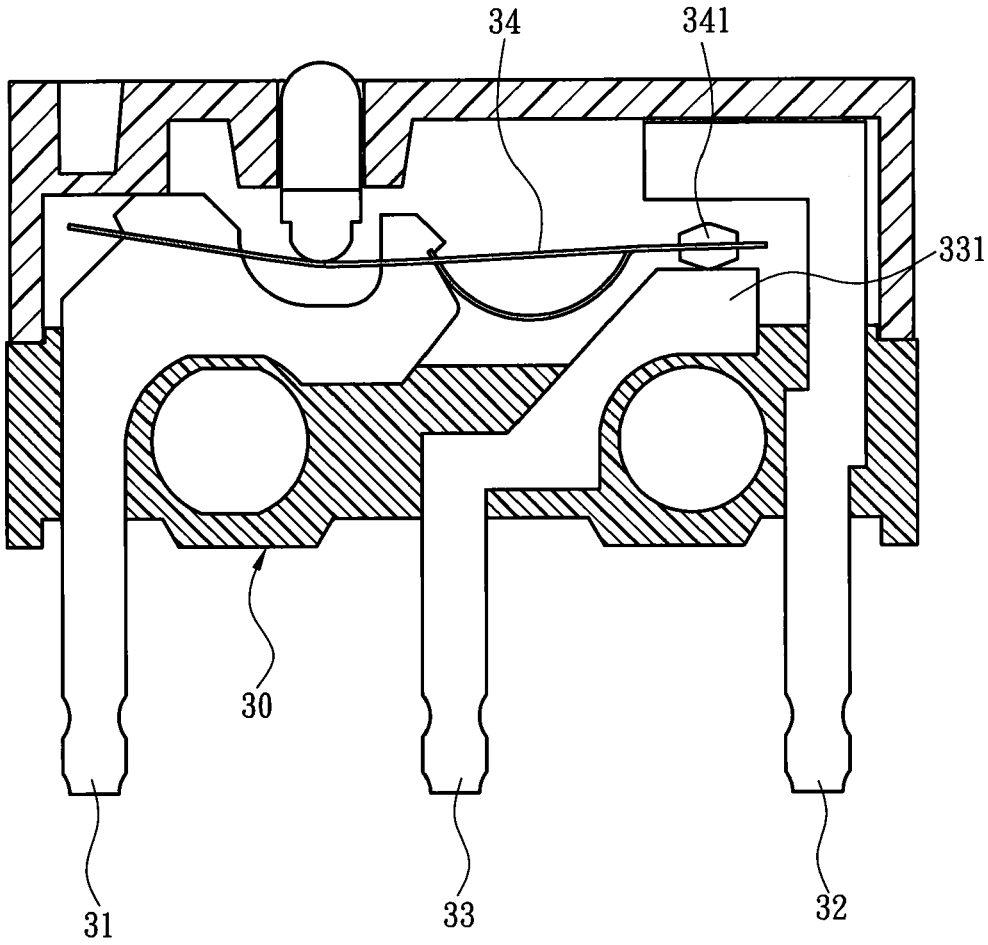
Fig. 1 PRIOR ART
FIG. 1 is a schematic view of a conventional technique.
Figure 2:
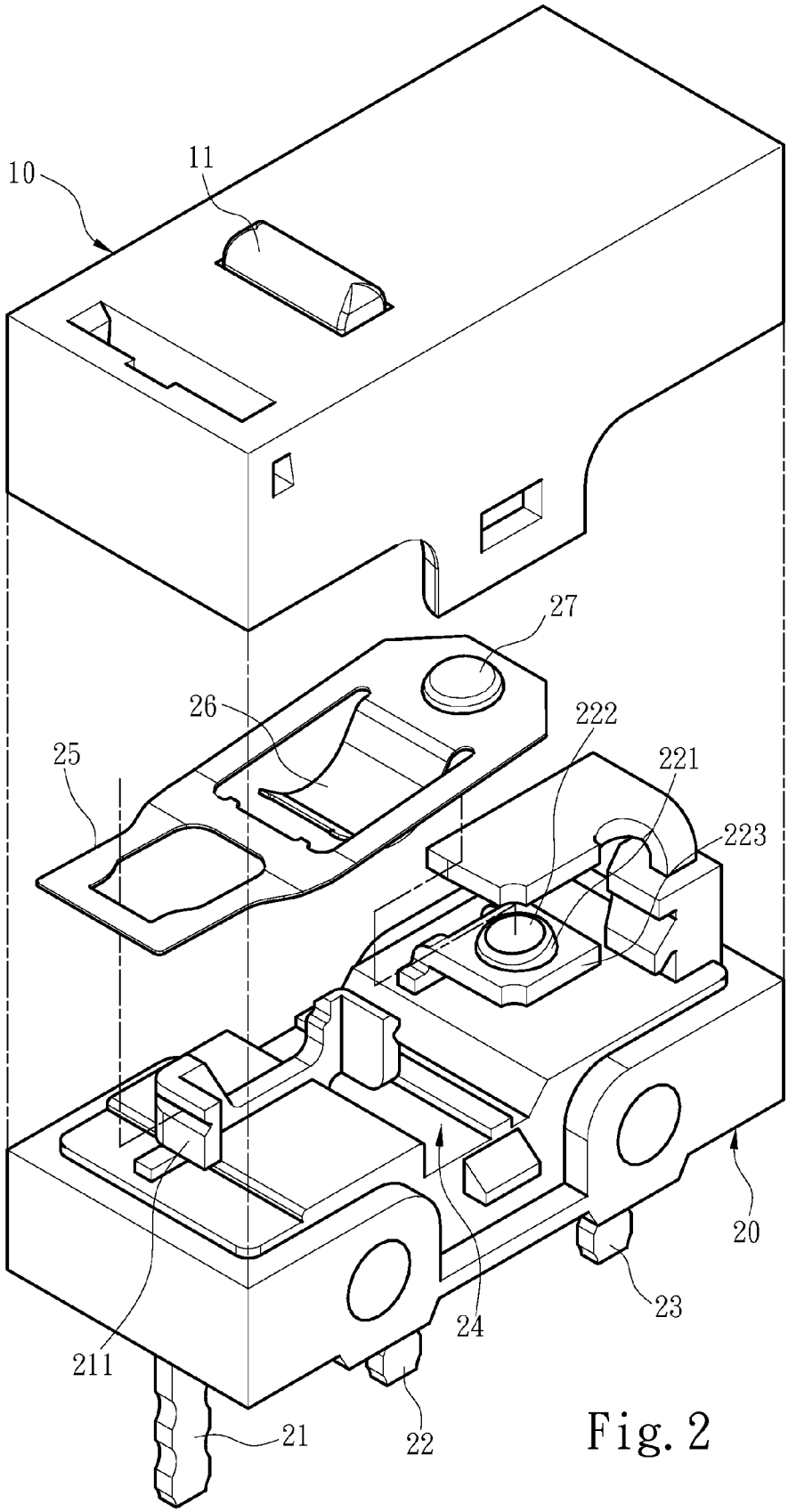
FIG. 2 is an exploded view of the invention.
Figure 3A:
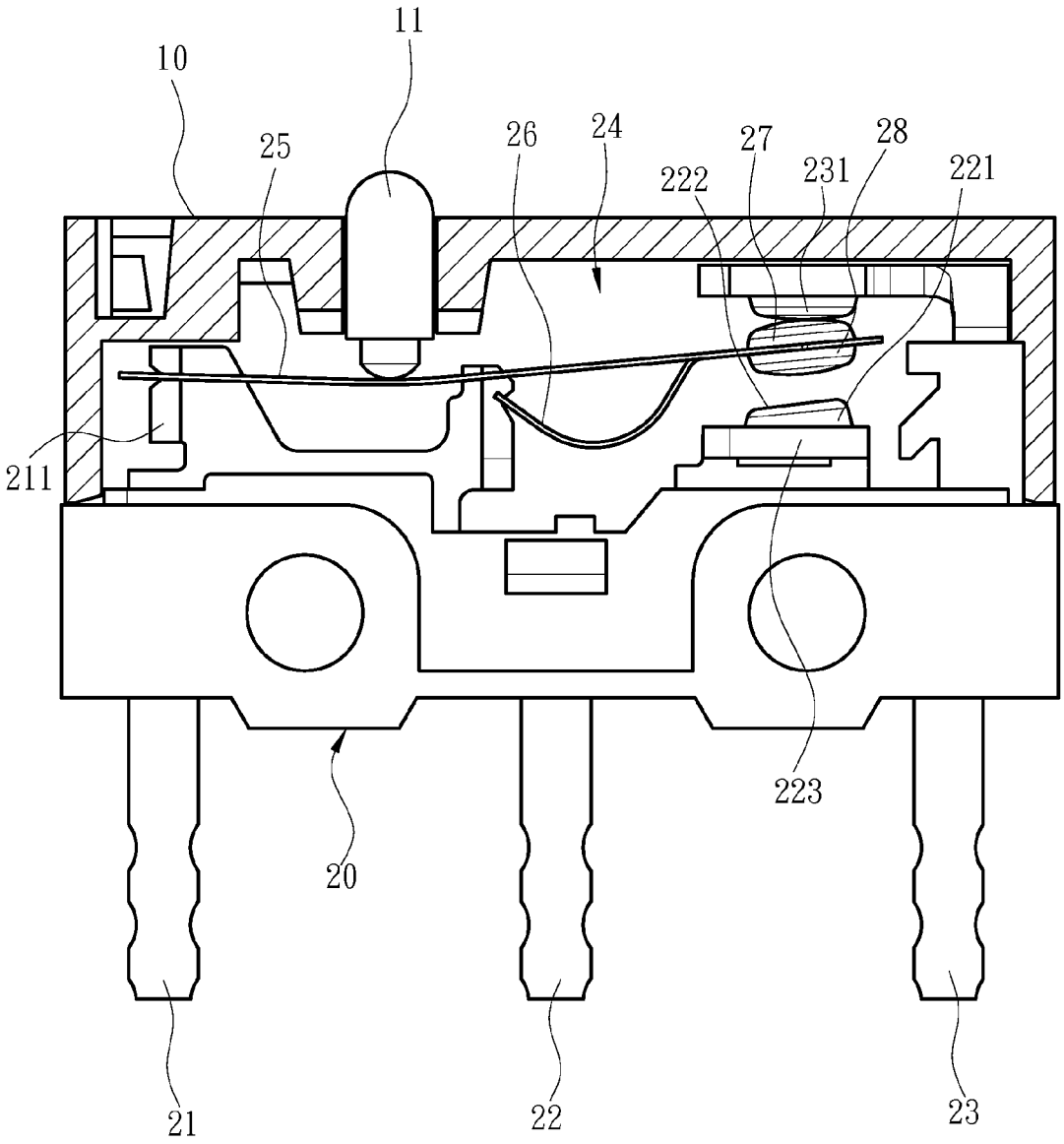
FIGS. 3A and 3B are schematic views of the invention in operating conditions.
Figure 3B:
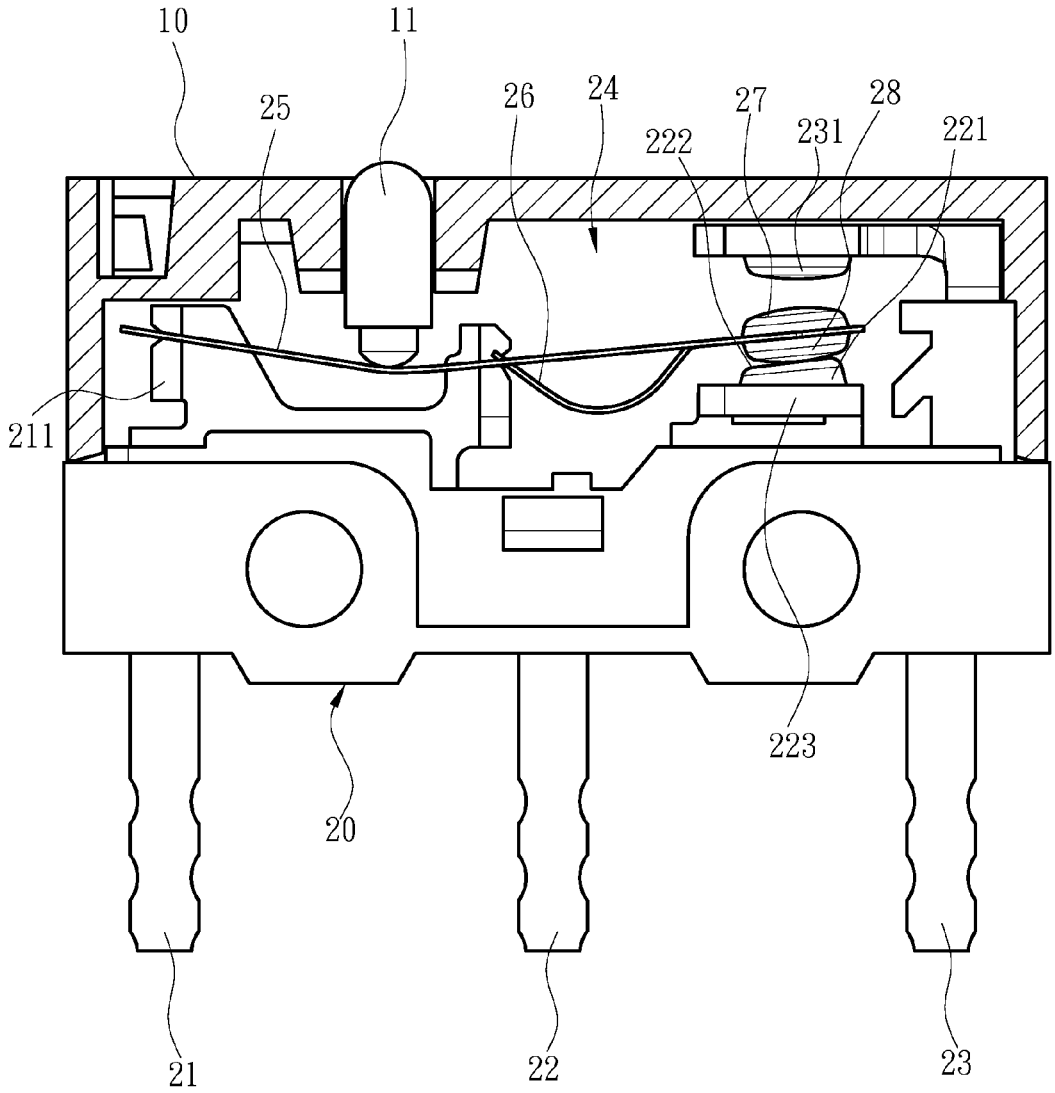

Please refer to FIGS. 2, 3A and 3B, the present invention aims to provide an enhanced returning elasticity micro switch that mainly includes a base 20 and a cap 10 mounted on the base 20 to form a housing compartment 24 between them. The cap 10 has a press element 11 movable up and down. The base 20 is run through by at least a first pin 21 and a second pin 22. In an embodiment shown in the drawings, the base 20 is also run through by a third pin 23. The micro switch is installed in an electronic device (not shown in the drawings), such a circuit board, through the first, second and third pins 21, 22 and 23. The first pin 21 has an anchor portion 211 located in the housing compartment 24 to couple with a conductive member 25 pressed by the press element 11. The conductive member 25 is a conductive reed and has an elastic element 26 braced by the anchor portion 211. The conductive member 25 has one end fastened to the anchor portion 211 and another end with an upper contact portion 27 on an upper side and a lower contact portion 28 on a lower side.

The second pin 22 and third pin 23 have respectively a first contact 221 and a second contact 231 located in the housing compartment 24. The first contact 221 and the second contact 231 are located respectively on the lower side and on the upper side of the conductive member 25 corresponding to the lower contact portion 28 and upper contact portion 27. The first contact 221 has an inclined surface 222 corresponding to the lower contact portion 28 and formed at an elevation tapered towards the anchor portion 211 of the first pin 21. The second pin has a coupling portion 223 in the housing compartment parallel with an upper surface of the base to couple with the first contact 221.

Figure 4:
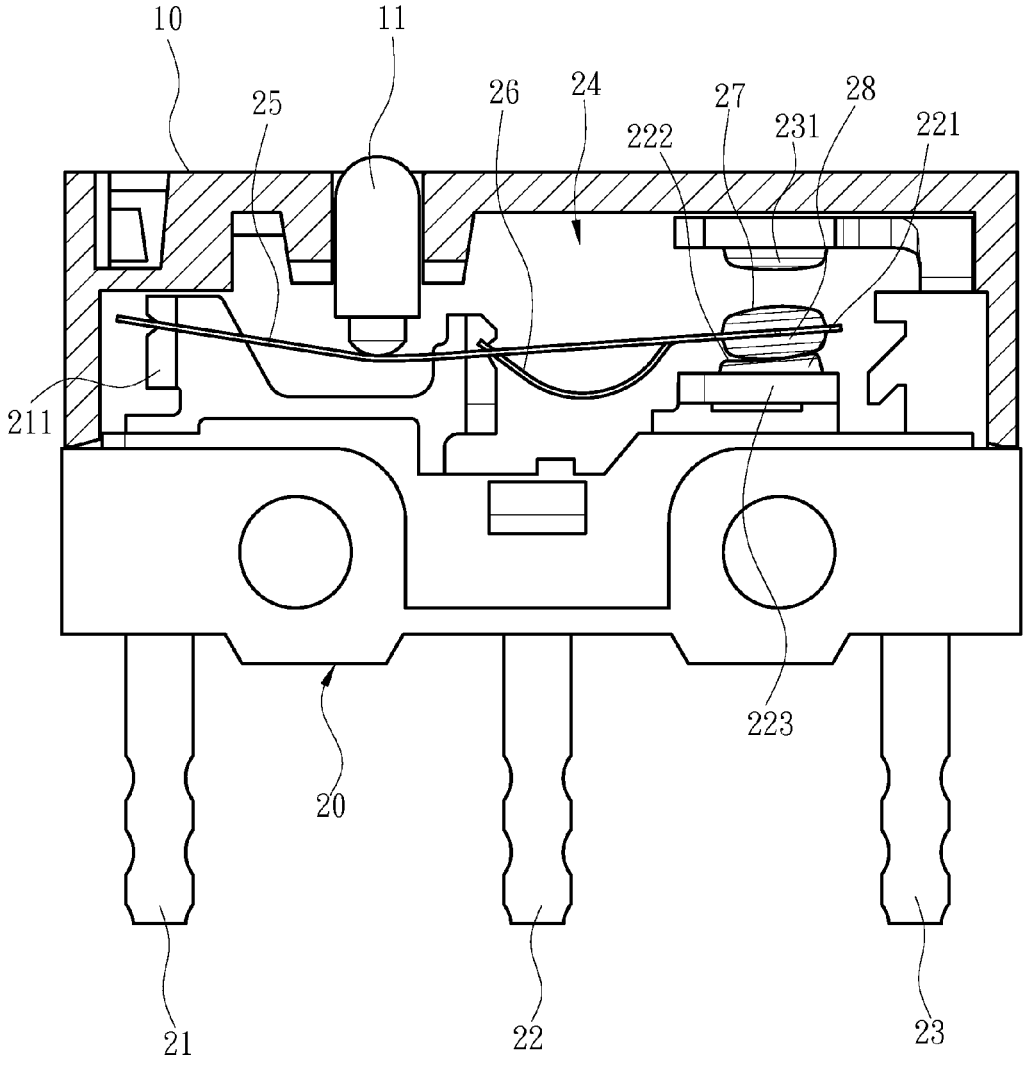
FIG. 4 is a schematic view of another embodiment of the invention.

The conductive member 25 is braced upwards by the elastic force of the elastic element 26 in normal conditions to push the press element 11 upwards, and the upper contact portion 27 butts the second contact 231 of the third pin 23 so that the first pin 21 and third pin 23 are electrically connected (referring to FIG. 3A). In the event that a pressing force is exerted to the press element 11, it is moved downwards to press the conductive member 25 which is deformed and swung downwards, and the lower contact portion 28 connects the inclined surface 222 of the first contact 221 of the second pin 22 so that the first pin 21 and second pin 22 are electrically connected (referring to FIG. 3B). The inclined surface 222 may be a plane surface as shown in the drawings, or a cambered surface as shown in FIG. 4.

Thus, by forming the inclined surface 222 on the first contact 221 of the second pin 22, when a user wants to output an operation command or a signal and presses the micro switch, the conductive member 25 is depressed and deformed to swing downwards, and through the lower contact portion 28 contacting the inclined surface 222, the first pin 21 and the second pin 22 are connected through contact surfaces to transmit electricity. Such a structure provides many benefits over the conventional techniques, notably:

1. The area of power transmission is increased, and the temperature at the contact area between the conductive member 25 and second pin 22 also is decreased, thus the lifespan of the micro switch is prolonged.

2. The attraction force between the conductive member 25 and second pin 22 during power transmission decreases, and adhesive phenomenon of the conductive member 25 to the second pin 22 improves, hence returning elasticity of the conductive member 25 is enhanced.

3. Through the inclined surface 222, the downward swinging distance of the conductive member 25 increases, deformation of the conductive member 25 also enhances, and resistance against the depression of the press element 11 decreases. Hence operation is effort-saving and touch feel of pressing the micro switch also enhances.

4. The distance between the first contact of the second pin 22 and the second contact of the third pin 23 increases, thus can withstand a higher voltage test and pass safety approval of greater amperes.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An enhanced returning elasticity micro switch, comprising:

a base covered by a cap to form a housing compartment between them, the cap including a press element movable up and down;

a first pin running through the base and including an anchor portion in the housing compartment to couple with a conductive member pressed by the press element, the conductive member including a lower contact portion and swinging during up and down movement of the press element; and a second pin running through the base and including a coupling portion in the housing compartment parallel with an upper surface of the base to couple with a first contact connected to the lower contact portion during swing of the conductive member, the first contact including an inclined surface for increasing a swinging distance of the conductive member, the inclined surface being located at an elevation tapered towards the anchor portion of the first pin.

2. The enhanced returning elasticity micro switch of claim 1, wherein the inclined surface is a plane surface.

3. The enhanced returning elasticity micro switch of claim 1, wherein the inclined surface is a cambered surface.

4. The enhanced returning elasticity micro switch of claim 1, wherein the conductive member is a conductive elastic reed.

5. The enhanced returning elasticity micro switch of claim 1, wherein the conductive member includes an elastic element braced by the anchor portion to support the conductive member upwards in normal conditions.

6. The enhanced returning elasticity micro switch of claim 1, wherein the base further is run through by a third pin, the third pin including respectively a second contact and an upper contact portion contact with each other in normal conditions.

* * * * *